United States Patent [19]

Bommart

[11] 4,320,708

[45] Mar. 23, 1982

[54] DEVICES FOR ADJUSTING TWO BUTT ENDS OF RAILS TO BE CONNECTED BY WELDING

[75] Inventor: Patrick Bommart, Rueil-Malmaison, France

[73] Assignee: C. Delachaux, France

[21] Appl. No.: 127,327

[22] Filed: Mar. 5, 1980

[30] Foreign Application Priority Data

Mar. 5, 1979 [FR] France ..... 79 05621

[51] Int. Cl.[3] ..... E01B 29/46

[52] U.S. Cl. ..... 104/112; 29/281.5; 104/15; 219/53; 228/49 R; 269/43; 280/47.27; 414/457

[58] Field of Search ..... 104/1 R, 2, 3, 15; 269/43; 254/43; 29/281.5; 219/53, 54, 55, 101; 228/49 RB; 414/444, 457; 280/47.27

[56] References Cited

U.S. PATENT DOCUMENTS

| | | | |
|---|---|---|---|
| 1,878,809 | 9/1932 | Begtrup | 254/43 |
| 2,124,849 | 7/1938 | Drain, Jr. | 228/5.1 |
| 2,430,107 | 11/1947 | Cronrath | 280/47.27 X |
| 3,635,165 | 1/1972 | Platov et al. | 104/15 |
| 3,802,348 | 4/1974 | Bryan, Jr. | 104/15 |
| 3,982,091 | 9/1976 | Zollinger | 219/101 |
| 4,215,260 | 7/1980 | Zollinger | 219/53 |
| 4,270,036 | 5/1981 | Zollinger | 219/53 |

FOREIGN PATENT DOCUMENTS

| | | | |
|---|---|---|---|
| 2000829 | 1/1979 | United Kingdom | 104/1 R |

*Primary Examiner*—Randolph A. Reese

*Attorney, Agent, or Firm*—Parmelee, Miller, Welsh & Kratz

[57] ABSTRACT

A device for adjusting two butt ends of rails to be connected by welding comprises a rigid structure which is formed by two support plates. The support plates are aligned and interconnected by a concave part and which is able to be disposed horizontally so that the two support plates are pressed one against one vertical side of the head of one of the rails and the other against the corresponding vertical side of the head of the other rail. The concave part provides a region for access around the butt ends. Each support plate is provided with a retaining clamp which is provided with a jaw able to bear against the opposite vertical side of the head of the rail. The device can be applied to the welding of rails on a track or on a fixed installation.

10 Claims, 10 Drawing Figures

DEVICES FOR ADJUSTING TWO BUTT ENDS OF RAILS TO BE CONNECTED BY WELDING

The present invention relates to a device for the adjustment of two butt ends of rails to be connected by welding.

In operations for connecting two butt ends of rails, in particular railway rails, it is necessary to proceed with an adjustment of the rails before they are connected by welding.

This adjustment consists of adjusting the gap size between the two butt ends of the rails to be connected, of aligning the inner vertical sides of the heads of the rails to be connected and of raising the butt ends slightly.

These adjusting operations take place either manually by means of suitable keys, or by means of more or less sophisticated machines.

The present invention intends to provide a device of much simpler construction than machines currently in existance, with a view to obtaining semi-manual adjustment of the rails to be connected by welding. To this end, the invention relates to a device which makes it possible to adjust the alignment of the inner vertical sides of the rail heads, the operation of adjusting the gap size being carried out previously and the operation of raising the butt ends being carried out afterwards either manually by means of a set of suitable keys, or by means of screw-jacks or hydraulic jacks.

More precisely, the device of the invention comprises a rigid structure which is formed by two support plates which are aligned and inter-connected by a concave part and which is able to be disposed horizontally so that the two support plates are applied one against one vertical side of the head of one of the rails and the other against the corresponding vertical side of the head of the other rail, the concave part providing an access region around the butt ends, each support plate being provided with a retaining clamp provided with a jaw able to bear against the opposite vertical side of the rail head.

In a preferred embodiment of the device of the invention, the two support plates are each provided with two supports spaced apart in order to form four spaced supports constituting a reference line for the alignment of the rails and each retaining clamp is located substantially at an equal distance between the two supports of the corresponding support plate.

The distance between the two retaining clamps thus makes it possible to place a ruler on the top of the rail heads, in order to check the correct raising of the butt ends. Furthermore, the access region provided around the butt ends by the concave part of the device makes it possible to place a ruler on the inner vertical side of the heads of the two rails in order to check the correct vertical alignment of these sides.

The result of this is that after tightening of the two retaining clamps, the alignment of the vertical sides of the heads of the two rails is automatically achieved by virtue of the four aforesaid supports, the adjustment of the gap size having been effected previously.

In addition to the operation for adjusting the vertical sides of the rail heads, in order to make it possible to carry out an operation for adjusting the alignment of the rail flanges, each support plate is provided with an anchoring block able to receive a clamp for adjusting the alignment of the rail flanges. This clamp is provided with a jaw able to bear against the end of the rail flange of which one wishes to modify the elevation in order that the two rail flanges are aligned.

The structure of the device of the invention is advantageously provided with a crucible-support able to receive an aluminothermic crucible for welding the rails.

According to another feature of the adjusting device of the invention, the latter may be used for welding on the spot or welding at a fixed point.

In the first case, the adjusting device will advantageously be conveyed to the welding location by means of a suitable carriage, whereas in the second case, the adjusting device will be integral with a fixed installation.

The movable carriage used to convey the adjusting device may be constituted for example by a carriage with two wheels of the trolley type comprising two supports able to receive the adjusting device in a detachable manner, which device is disposed horizontally. A carriage of this type is particularly suitable for conveying the adjusting device with a view to carrying out welding on roadways, for example welding tramway rails.

The carriage may also be constituted by a self-propelling carriage of the lorry type which is able to move on the railway track and comprising at least one adjusting device supported by a pivoted arm.

This carriage will be provided with a driving motor and an appropriate source of power and it may also advantageously constitute a means of transport for the welding equipment, i.e. the consumable material for producing the welds, tools whether or not supplied by the source of power and serving for example for cutting the rails, for removing burrs from the welds, for grinding the welds etc.

Furthermore, this carriage will advantageously be able to be derailed, i.e. provided with means for moving it laterally away from the railway track so that if necessary it allows the passage of a train on the track between two welding operations.

In a carriage of this type, it will be preferable to provide at least two adjusting devices disposed in a removable manner in order to make it possible to carry out two simultaneous adjusting operations, one on each line of rails.

When the adjusting device of the invention is used on a fixed installation, the latter is mounted to pivot about a horizontal axis of the frame of the installation, parallel to the direction of alignment of the support plates, i.e. parallel to the direction of alignment of the rails. In an installation of this type, the rails are supplied and removed by means of rollers and a suitable hauling arrangement.

In an installation of this type, the anchoring blocks intended to receive the clamp for adjusting the elevation and the crucible support are advantageously provided on the frame of the installation instead of being provided on the structure of the device as mentioned previously in the case of devices supported on a carriage.

This fixed installation will advantageously comprise a burr-removing arrangement able to eliminate the weld bead formed and actuated by at least one jack moving parallel to the direction of the rails.

Further features and advantages of the invention will become apparent from the ensuing description of several non-limiting examples of devices constructed according to the invention and with reference to the accompanying drawings in which.

Figure 1:
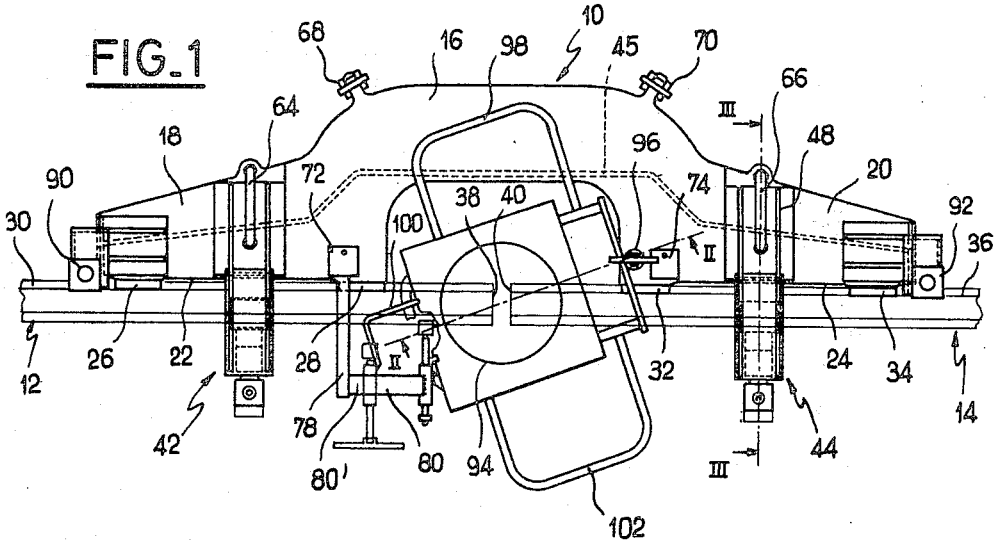
FIG. 1 is a plan view of a device according to the invention in position on two rails to be adjusted and which is equipped with an aluminothermic crucible.

FIG. 1 shows an adjusting device 10 according to the invention positioned on two rails 12 and 14 which are to be adjusted. The device 10 is constituted by a rigid structure formed by a sheet of steel of great thickness, for example 15 mm. This structure is in the form of a concave part 16 of U shape terminating in two support plates 18 and 20 provided with two respective edges 22 and 24. The support plate 18 is provided with two supports 26 and 28 integral with the edge 22 and intended to be pressed against the vertical side 30 of the head of the rail 12. Similarly, the support plate 20 is provided with two supports 32 and 34 integral with the edge 24 and intended to be pressed against the vertical side 36 of the head of the rail 14. The supports 26, 28, 32 and 34 are aligned in order to constitute a reference line for the alignment of the sides 30 and 36 of the heads of the rails 12 and 14.

The supports 28 and 32 are disposed in the immediate vicinity of the concave part 16 which defines a region for access around the two butt ends 38 and 40 to be adjusted and welded. The distance between the supports 28 and 32 is determined in order to be able to position a ruler, for example a half meter ruler, in order to check the correct alignment of the vertical sides 30 and 36 of the rails 12 and 14. The device 10 may be reinforced in its lower part by a bent sheet 45.

The adjusting device 10 is also provided with two retaining clamps 42 and 44 located substantially at an equal distance between the supports 26 and 28 on the one hand and the supports 32 and 34 on the other hand. The distance between the two clamps 42 and 44 makes it possible to position a ruler, for example a one meter ruler, on the top of the heads of the rails 12 and 14, in order to check correct raising of the butt ends. These two clamps 42 and 44 are identical and the clamp 44 will be described hereafter with reference to FIGS. 1 and 3.

Figure 3:
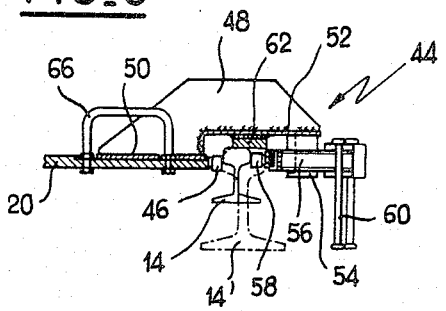
FIG. 3 is a sectional view on line III—III of FIG. 1 and showing a retaining clamp of the device.

As shown in FIG. 3, the clamp 44 is provided with a fixed jaw 46 fixed to the edge 24 of the support plate 20 in order to be aligned with the supports 32 and 34. The clamp 44 is also provided with a support 48 of U shaped section, whereof one end 50 is integral with the support plate 20 and whereof the other end 52 is integral with a block 54 which has an internal screw thread. This block 54 serves for the passage of a screw threaded rod 56, whereof one end is provided with a jaw 58 which is mounted to rotate freely and constitutes the movable jaw of the clamp 44 and the other end of which is provided with a control lever 60.

The support 48 is also provided on its lower side, in the portion comprised between its ends 50 and 52, with a support 62 intended to cooperate with the top of the head of the rail 14.

As shown in FIG. 3, the clamp 44 may be adapted both to a rail 14 of small dimensions as well as to a rail 14' of larger dimensions.

The device 10 is also provided with two handles 64 and 66 intended to facilitate its conveyance and with two retractable and adjustable feet 68 and 70 intended to keep the device horizontal.

Figure 2:
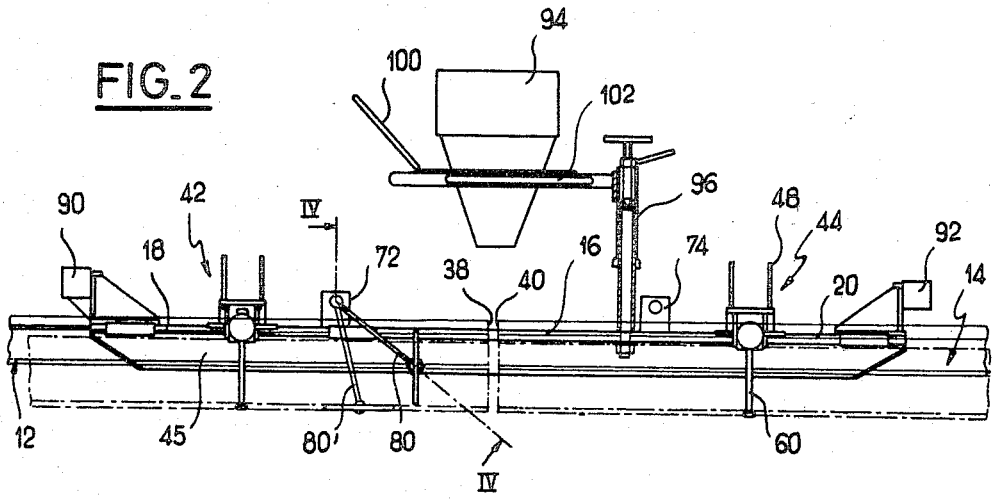
FIG. 2 is a front view of the device of FIG. 1, the aluminothermic crucible being seen in cross-section on line II—II of FIG. 1.
Figure 4:
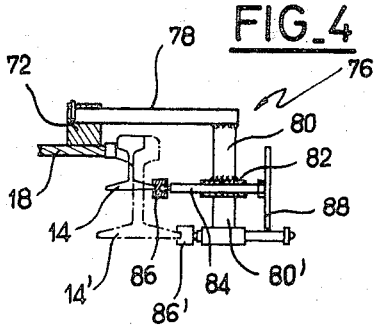
FIG. 4 is a sectional view on line IV—IV of FIG. 2 and showing a clamp for adjusting the alignment of the flanges of the device of FIGS. 1 and 2.

The retaining clamps 42 and 44 make it possible to ensure adjustment of the alignment of the vertical sides of the heads of the rails 12 and 14. In addition, in order to make it possible to adjust the alignment of the flanges or sole-plates of the rails 12 and 14, the device 10 is provided with two anchoring blocks 72 and 74 provided in the vicinity of the supports 28 and 32. These blocks may receive an adjusting clamp 76, which is removable and which will be explained in more detail with reference to FIG. 4. In FIGS. 1, 2 and 4, the clamp 76 is shown anchored to the block 72, but the latter may also be anchored to the block 74 depending on the relative arrangement of the flanges of the rails 12 and 14.

The clamp 76 comprises an arm 78 able to be anchored to the block 72 or to the block 74 with the possibility of pivotal movement and provided at its free end with a cranked extension 80. The extension 80 terminates in a sleeve 82 having an internal screw thread in order to receive a screw threaded rod 84, whereof one end is provided with a jaw 86 mounted to move freely and whereof the other end is provided with a lever 88 intended to ensure entrainment of the screw threaded rod 84 and consequently the movement of the jaw 86. As illustrated in FIG. 4, the jaw 86 comes to bear against the outer end of the flange of a rail 14 of small dimensions. This jaw may occupy a position 86' in order to come to bear against the outer end of the flange of a rail 14' of larger dimensions, the cranked extension 80 thus occupying a different angular position 80' (see FIG. 2).

The adjusting device 10 is furthermore provided at its two ends with two securing blocks 90 and 92 intended if necessary to connect the adjusting device 10 to a conveying carriage of the lorry type, as will be explained hereafter with reference to FIG. 6.

The device 10 is also provided with an aluminothermic crucible 94 supported by a pivoting and vertically adjustable stand 96, the base of which is fixed to the adjusting device itself. Operating handles 98, 100 and 102 are provided for moving the crucible and bringing the latter into a position above the gap between the two butt ends 38 and 40, as illustrated in FIGS. 1 and 2.

The device illustrated in FIGS. 1 to 4 is used in the following manner.

After having previously adjusted the gap size between the two butt ends 38 and 40 to be welded by a suitable method which is known per se, the device is brought into the position as illustrated in FIGS. 1 and 2. Then, the clamps 42 and 44 are tightened provisionally in order to keep the device in position and to align the inner vertical sides of the heads of the two rails. The two butt ends to be welded are thus raised slightly by using suitable keys or screw jacks or hydraulic jacks so that the rails form a "point". By means of a ruler, one then checks that the alignment of the inner sides of the heads of the rails is correct and by means of another ruler placed on the top of the heads of the rails between the clamps 42 and 44, one checks that the "point" of the rails is correct If the alignment of the flanges of the two rails is not correct, one uses the clamp 76 which is fixed to the appropriate anchoring block, i.e. that corresponding to the rail whereof the flange is furthest from the device. By means of the lever 88, the jaw 86 is moved in order to bring the flange of the corresponding rail progressively into alignment with the flange of the other rail. The two rails are thus locked by completely tightening the two clamps 42 and 44. One may thus proceed to welding of the rails using the aluminothermic crucible 94, then eliminating the excess weld by means of a suitable burr-removing arrangement.

As mentioned previously, the device of FIGS. 1 to 4 may be conveyed to the welding site by means of a suitable carriage.

Figure 5:
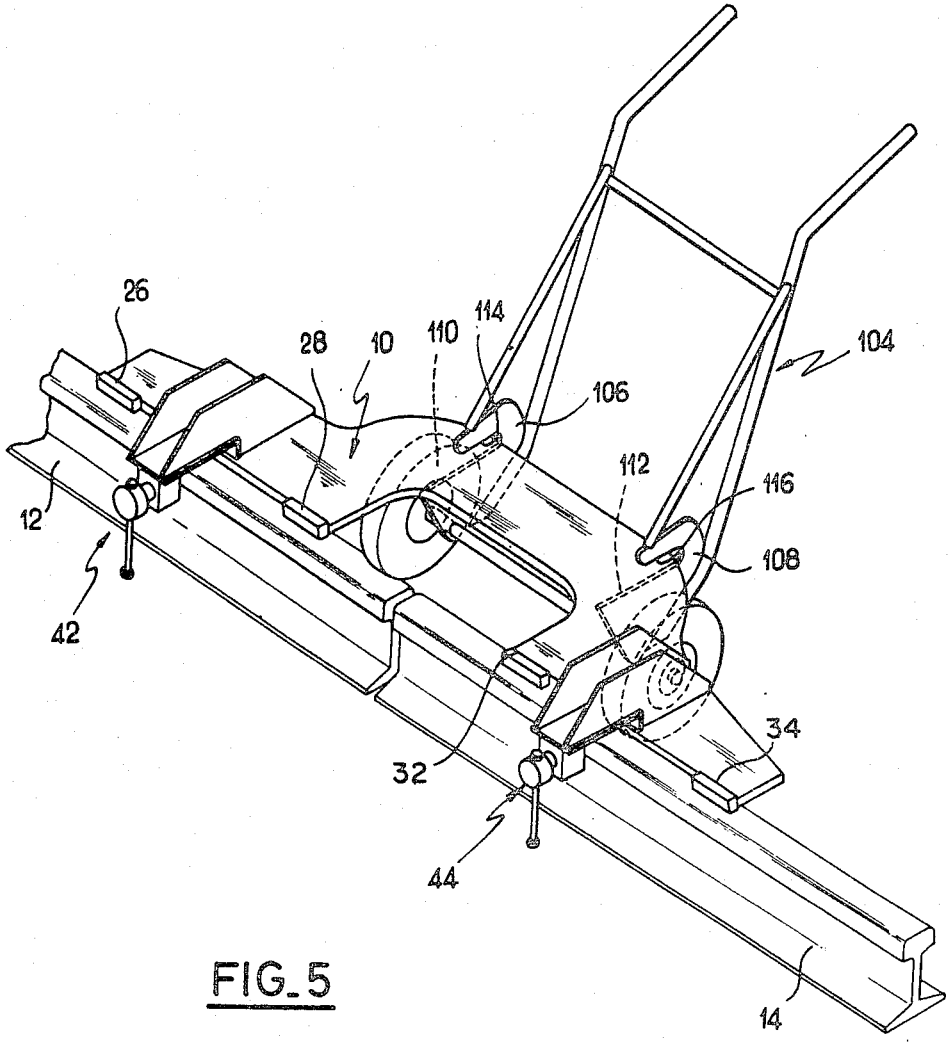
FIG. 5 is a perspective view showing a carriage with two wheels of the trolley type, intended for conveying a device according to the invention in order to ensure its positioning on two rails to be adjusted.

FIG. 5 shows a carriage 104 with two wheels, of the trolley type, provided with two supports 106 and 108 able to receive the adjusting device 10 in a detachable manner, which device is disposed horizontally. The supports 106 and 108 are identical and cut out in order to constitute respectively rectilinear lower supports 110 and 112 and recesses 114 and 116 having an opening which is slightly greater than the thickness of the metal sheet constituting the device 10, in order to hold the device 10 by a simple over-hanging effect.

A carriage 104 of this type is particularly suitable for conveying the adjusting device for bringing the latter to the welding site in the case where the rails are located on roadways, as in the case of tramway rails.

Figure 6:
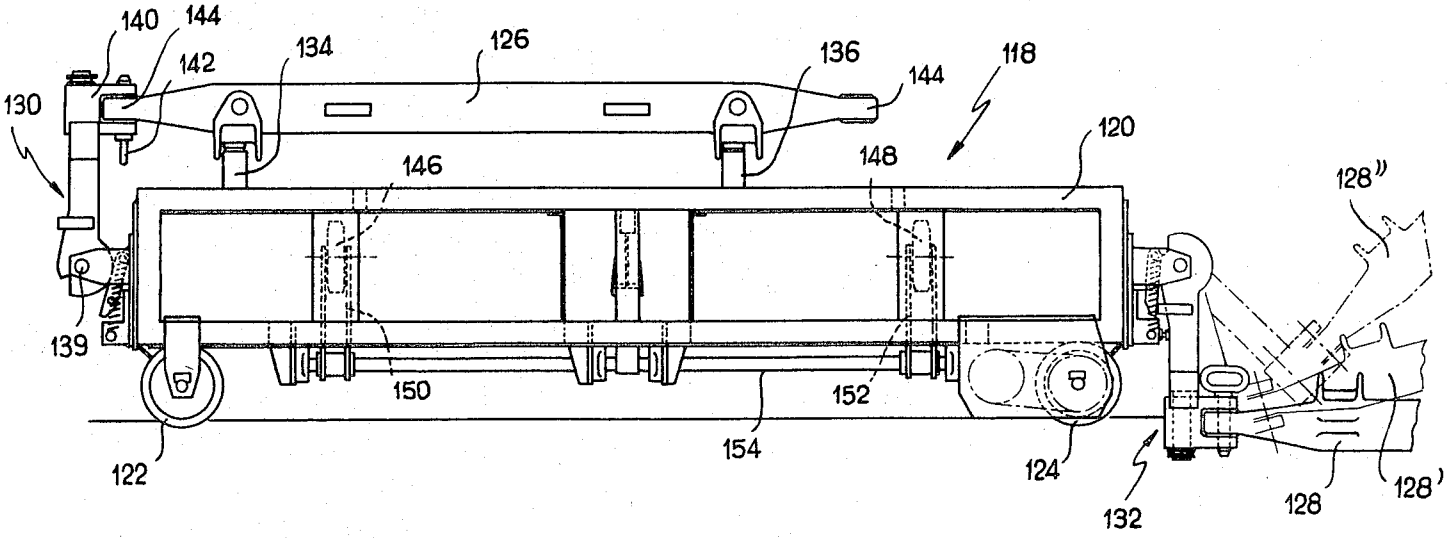
FIG. 6 is a side view of a carriage of the lorry type provided with two adjusting devices according to the invention.
Figure 7:
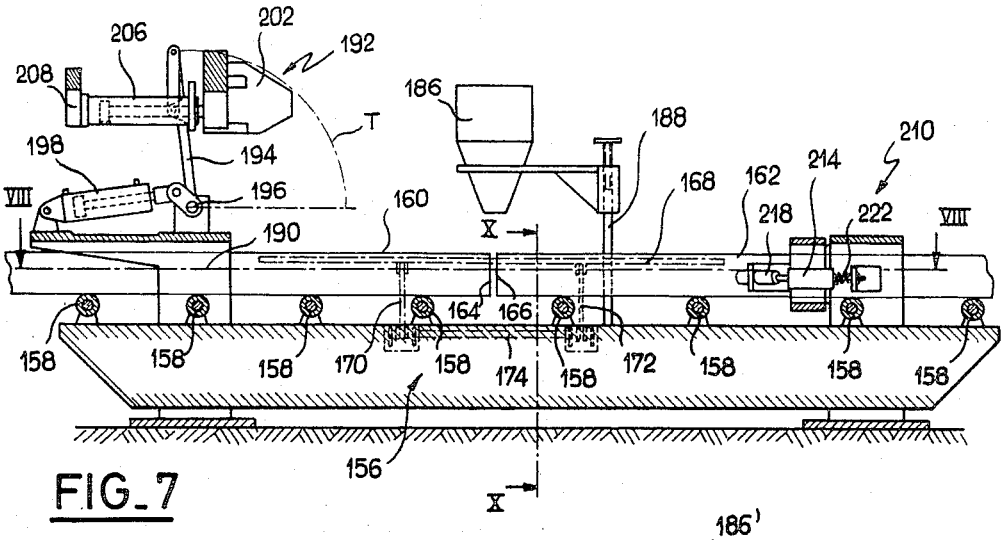
FIG. 7 is a front view of a fixed installation equipped with a device according to the invention.
Figure 8:
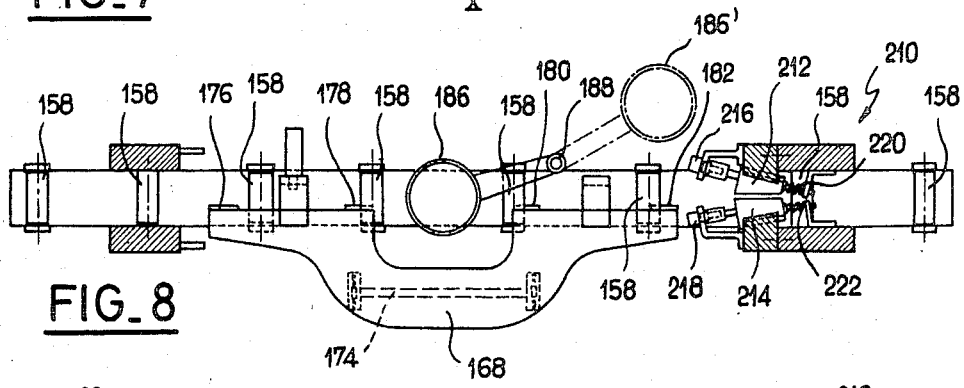
FIG. 8 is a sectional view taken on line VIII—VIII of FIG. 7.
Figure 9:
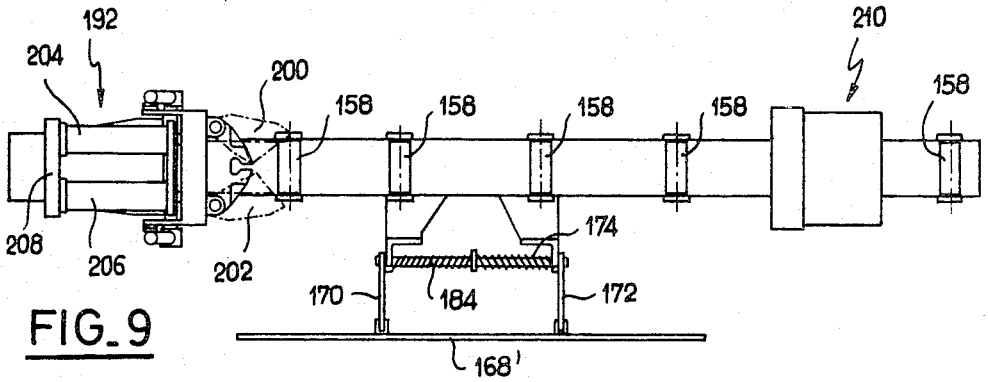
FIG. 9 is a plan view of the device of FIG. 7, the adjusting device being in the retracted position
Figure 10:
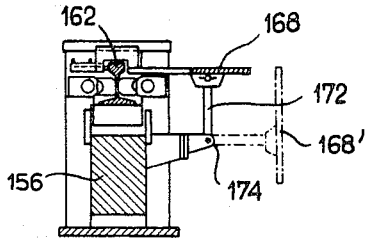
FIG. 10 is a sectional view on line X—X of FIG. 7.

FIG. 6 shows a self-propelling carriage 118, of the lorry type, able to move on railway track. This carriage 118 is constituted by a body 120 equipped with four wheels such as 122 and 124 and a source of power (not shown) intended to supply a motor driving the wheels such as 124.

The carriage 118 is provided with two adjusting devices 126 and 128 similar to the device 10 described previously, respectively supported by pivoted arms 130 and 132 provided at each of the ends of the carriage. In FIG. 6, the device 126 is illustrated horizontally in the conveying position supported on supports 134 and 136 integral with the body 120, whereas the device 128 is shown in the position of use, i.e. horizontally, at the level of the rails to be adjusted. The intermediate positions 128' and 128" illustrate the device in a position moving between two welding operations, the aluminothermic crucible remaining on the device. The arm 130 is pivoted about a horizontal pivot 139 integral with the body 120 and is provided at its free end with a fork joint 140 intended to receive the device 126 in a detachable manner, by means of a detachable cotter pin 142 passing through one of the fixing blocks 144 provided at the two ends of the device 126. The arm 132 is constructed in a manner similar to the arm 130.

The adjusting devices 126 and 128 are brought to the welding site by means of the carriage 118 and can then be detached from the carriage 118 if the two welds to be carried out are not in perfect facing relationship, in order to make it possible to carry out two simultaneous adjusting operations.

The body 120 of the carriage also constitutes conveying means for the equipment intended for the welding of the rails, such as for example an aluminothermic crucible, the materials necessary for the aluminothermic welding, adjusting keys, tools, whether or not supplied by the source of power of the carriage. Thus, this source of power may serve to supply tools for cutting rails, tools for removing burrs from the weld, grinding tools etc., for example hydraulically.

The carriage 118 is also provided with four retractable wheels such as 146 and 148, supported by arms such as 150 and 152, integral with a pivot such as 154, directed in the longitudinal direction of the carriage, i.e. parallel to its direction of forwards movement. These wheels 146 and 148 may be brought by suitable means (not shown) into a position for bringing about derailing of the carriage, i.e. shifting the latter transversely and causing it to leave the rails on which it moves, for example in order to allow the passage of a train between two adjusting operations. In order to effect this derailing operation, it is also necessary to place sections of rail on the one hand between the two rails of the track, at right angles to the direction of the track and on the other hand on the outer side of the track towards which one wishes the carriage to move.

FIGS. 7 to 10 illustrate a fixed installation provided with an adjusting device according to the invention. This fixed installation comprises a frame 156 fixed to the ground and provided with a plurality of rollers 158 intended to provide sliding of two rails 160 and 162 by means of a hauling device (not shown) in order to bring the latter into a position such that their respective butt ends 164 and 166 are in the adjusting and welding position, i.e. substantially at the center of the frame 156, while leaving the necessary gap therebetween for the subsequent pouring of the aluminothermic weld. The frame 156 is provided with an adjusting device 168 according to the invention. This device 168 is integral with two arms 170 and 172 mounted to pivot about a pivot 174 of the frame 156, arranged parallel to the direction of the rails to be adjusted. The device 168 may be moved between an operating position, i.e. a horizontal position in which the supports 176, 178, 180 and 182 of the device come to bear against the sides of the heads of the rails (see FIGS. 7, 8 and 10) and a vertical retracted position 168' (see FIGS. 9 and 10). In order to facilitate the movement of the device from one of these two positions to the other, a compensating spring 184 is provided around the pivot 174 (see FIG. 9).

The frame 156 is furthermore provided with an aluminothermic crucible 186 supported by means of a pivoting and vertically adjustable stand 188, whereof the base is integral with the frame 156. This crucible 186 can be moved between an operating position 186 in which it is located just above the gap between the two butt ends 164 and 166 and a position 186' in which it is retracted (see FIG. 8.)

Also provided on the frame 156 is a support 190 provided with a burr-removing tool 192 intended to eliminate the excess weld formed around the butt ends after carrying out aluminothermic welding by means of the crucible 186. The burr-removing tool 192 is supported, suspended in a horizontal position, by an arm 194 able to pivot about a horizontal pivot 196 under the action of a jack 198 (see FIG. 7). This tool may be moved between an upper retracted position (see FIG. 7) and a lower operating position by following a circular trajectory T.

The tool 192 comprises two pivoting knives 200 and 202 able to be moved in the longitudinal direction of the rails under the action of two parallel jacks 204 and 206 resting by a base 208 on the support 190 when the tool 192 is in the operating position.

The movement of the knives causes the elimination of the excess weld formed at the junction of the two butt ends. During the welding and burr-removing operations, the rail 162 is retained by a locking arrangement 210 integral with frame 156. This arrangement comprises two movable wedges 212 and 214 able to move in symmetrical angular directions on either side of the longitudinal axis of the rails.

The two wedges 212 and 214 are actuated respectively under the action of the rotary driving heads 216 and 218 against the action of two springs 220 and 222.

The installation of FIGS. 7 to 10 is used in the following manner. The two rails to be welded are supplied, by causing them to slide on the rollers in order that the butt ends to be welded are located in the central region of the frame, thus providing a suitable gap between the butt ends. The adjusting device is brought into the operating position and adjustment is carried out as above mentioned. The locking arrangement is actuated in order to lock the corresponding rail. The aluminothermic crucible is brought into the welding position and welding is carried out.

The crucible is then removed and the adjusting device is returned to its retracted position.

Removal of the welding burr is then carried out and the locking arrangement is unlocked. It is then possible to move the rail on the rollers in order to discharge the latter or in order to add a new section thereto by welding.

The device of the invention may thus be used for welding rails, in particular railway rails, on the track or in a fixed installation.

What is claimed is:

1. An apparatus for the adjustment of two butt ends of rails to be connected by welding, comprising a rigid structure having first and second support plates which are aligned and inter-connected by a concave part, said rigid structure being horizontally disposed with said first support plate being pressed against one vertical side of the head of one of the rails and with the second support plate being pressed against the corresponding vertical side of the head of the other rail, a region for access being defined around the butt ends by said concave part, said rigid structure including a retaining clamp mounted on each support plate, each of said retaining clamps having a movable jaw to bear against the opposite vertical side of the head of the appropriate rail, and said rigid structure having two supports integral with each of said first and second support plates, said supports being spaced apart in order to form four spaced supports constituting a reference line for the alignment of the rails.

2. A device as claimed in claim 1, in which each retaining clamp is located substantially at a equal distance between the two supports of the corresponding support plate.

3. An adjusting device according to claim 1 including an adjusting clamp for aligning the flanges of the rails and the vertical sides of the heads of the rails and an anchoring block provided for each support plate and capable of receiving said adjusting clamp, said clamp having a movable jaw for bearing against the end of the flange of the rail whereby the two rail flanges and rail heads can be aligned.

4. A movable carriage equippped with at least one device as claimed in claim 1.

5. A carriage as claimed in claim 4, which comprises two wheels of the trolley type, and two supports able to receive the adjusting device, in a detachable manner, which device is disposed horizontally.

6. A carriage as claimed in claim 4, which comprises a self-propelling carriage of the lorry type able to move on railway track and at least one adjusting device supported by a pivoted arm.

7. A carriage as claimed in claim 6, which constitutes a conveying means for the equipment intended for welding the rails.

8. A fixed installation for assembling rails by welding, comprising a frame provided with an adjusting device as claimed in claim 1.

9. An installation as claimed in claim 8, in which the adjusting device is mounted to pivot about a horizontal axis of the frame, parallel to the direction of alignment of the support plates.

10. A fixed installation as claimed in claim 8 including an adjusting clamp for aligning the flanges of the rails and the vertical sides of the heads of the rails and an anchoring block provided for each support plate and capable of receiving said adjusting clamp, said clamp having a movable jaw for bearing against the end of the flange of the rail whereby the two rail flanges and rail heads can be aligned.

* * * * *